US009635716B2

(12) United States Patent
Hayakawa et al.

(10) Patent No.: US 9,635,716 B2
(45) Date of Patent: Apr. 25, 2017

(54) HIGH-FREQUENCY COOKER

(75) Inventors: Yuji Hayakawa, Shiga (JP); Kuniaki Abe, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 33 days.

(21) Appl. No.: 14/128,872

(22) PCT Filed: Jul. 26, 2012

(86) PCT No.: PCT/JP2012/004785

§ 371 (c)(1),
(2), (4) Date: Dec. 23, 2013

(87) PCT Pub. No.: WO2013/014941

PCT Pub. Date: Jan. 31, 2013

(65) Prior Publication Data

US 2014/0144905 A1 May 29, 2014

(30) Foreign Application Priority Data

Jul. 26, 2011 (JP) ..... 2011-162738

(51) Int. Cl.
*H05B 6/64* (2006.01)
*H05B 6/70* (2006.01)

(52) U.S. Cl.
CPC ..... *H05B 6/6408* (2013.01); *H05B 6/6402* (2013.01); *H05B 6/6405* (2013.01); *H05B 6/707* (2013.01)

(58) Field of Classification Search
CPC ..... H05B 6/72; H05B 6/68; F24C 7/02; F24C 7/64; F24C 7/6402; F24C 7/6405; F24C 7/6408

(Continued)

(56) References Cited

U.S. PATENT DOCUMENTS 4,316,069 A 2/1982 Fitzmayer
4,623,781 A 11/1986 Thomas (Continued)

FOREIGN PATENT DOCUMENTS

CN 1184919 A 6/1998
CN 2300827 Y 12/1998

(Continued)

OTHER PUBLICATIONS

Extended European Search Report in corresponding European Application No. 12817165.9, dated Dec. 4, 2014, 5 pages.

(Continued)

*Primary Examiner* — Dana Ross
*Assistant Examiner* — Ayub Maye
(74) *Attorney, Agent, or Firm* — Brinks Gilson & Iione

(57) ABSTRACT

A high-frequency cooker includes: a heating chamber; a high-frequency generating device; a waveguide which is formed on a surface opposite to the heating chamber and which guides a microwave generated by the high-frequency generating device; a power feed port which is formed on a wall of the heating chamber and which allows the microwave guided by the waveguide to be supplied into the heating chamber; a microwave transmitting cover which closes the power feed port; and an umbrella-shaped member which is provided on a surface upper than the power feed port so as to cover an upper edge of the microwave transmitting cover. The umbrella-shaped member includes a step provided at both end portions of the umbrella-shaped member to reduce a gap with a wall surface of the heating chamber, and the microwave transmitting cover is fixed so as to be inserted into the gap.

2 Claims, 4 Drawing Sheets

(58) Field of Classification Search
USPC ..... 219/756, 749, 746
See application file for complete search history.

(56) References Cited

U.S. PATENT DOCUMENTS

| | | | | |
|---|---|---|---|---|
| 4,733,037 | A * | 3/1988 | Nitta | H05B 6/72 219/748 |
| 5,874,716 | A * | 2/1999 | Park | H05B 6/70 219/746 |
| 2004/0188431 | A1 | 9/2004 | Mitsumoto et al. | |

FOREIGN PATENT DOCUMENTS

| | | | | |
|---|---|---|---|---|
| JP | 04-209493 | A | | 7/1992 |
| JP | 2003-086349 | A | | 3/2003 |
| JP | 2003-142250 | A | | 5/2003 |
| JP | 3619955 | B2 | | 2/2005 |
| JP | 2010286195 | A | * | 12/2010 |
| JP | 2011174670 | A | * | 9/2011 |

OTHER PUBLICATIONS

Office Action and Search Report, and English translation thereof, in corresponding Chinese Application No. 201280036585.1, dated Apr. 24, 2015, 11 pages.
International Search Report for International Application No. PCT/JP2012/004785, dated Aug. 21, 2012, 1 page.

* cited by examiner

HIGH-FREQUENCY COOKER

This application is a 371 application of PCT/JP2012/004785 having an international filing date of Jul. 26, 2012, which claims priority to JP2011-162738 filed Jul. 26, 2011, the entire contents of which are included herein by reference.

TECHNICAL FIELD

The present invention relates to a high-frequency cooker such as a microwave oven which guides a microwave by a waveguide and supplies the microwave into a heating chamber through a power feed port.

BACKGROUND ART

Conventionally, a high-frequency cooker includes: a power feed port for supplying a microwave which is generated from a magnetron serving as microwave generating means and which is guided by a waveguide into a heating chamber; and a microwave transmitting cover which closes the power feed port.

FIG. 4 is a cross-sectional view of a conventional high-frequency cooker showing a relevant part, and the conventional high-frequency cooker includes a magnetron 2, a waveguide 3, and a microwave transmitting cover 5 as shown in FIG. 4.

In addition, there is a conventional high-frequency cooker which includes a power feed port 4, and a power feed port circumference pushing member 7 formed at a power feed port circumferential portion (e.g., see Patent Document 1).

RELATED ART DOCUMENTS

Patent Documents

Patent Document 1: JP-A-4-209493

SUMMARY OF THE INVENTION

Problem to be Solved by the Invention

In the above-described conventional configurations, a microwave generated from the magnetron 2 is guided by the waveguide 3, and is supplied into a heating chamber 1 through the power feed port 4, whereby food in the heating chamber is cooked. At this time, a wall surface electric current by the microwave flows on an edge face of the power feed port 4, thereby generating heat. This generated heat melts/deforms the microwave transmitting cover 5.

However, there is a conventional configuration in which the power feed port circumferential portion does not contact the microwave transmitting cover 5 by providing the power feed port circumference pushing member 7 formed at the power feed port circumferential portion, whereby the microwave transmitting cover 5 is not easily molten/deformed.

However, even in this conventional configuration, there is a problem in which when a vapor or seasoning arising from the food in the heating chamber 1 at the microwave cooking of the food is dispersed, the vapor or seasoning adheres to a wall surface of the heating chamber 1, flows to adhere to a front side or a back side of the microwave transmitting cover 5, and is heated by the microwave, whereby the microwave transmitting cover 5 is molten/deformed.

An object of the present invention is to provide a high-frequency cooker which prevents contamination due to vapor or seasoning from food and also prevents a microwave transmitting cover from being molten/deformed.

Means for Solving the Problem

In order to solve the problem in the related art, a high-frequency cooker of the present invention includes: a microwave transmitting cover which closes a power feed port; and an umbrella-shaped member which is provided on a surface upper than the power feed port so as to cover an upper edge of the microwave transmitting cover.

Thus, even when a vapor or seasoning arising from food in a heating chamber at the microwave cooking of the food is dispersed, adheres to a wall surface of the heating chamber and flows down, the umbrella-shaped member prevents the vapor or seasoning from adhering to a front side or a back side of the microwave transmitting cover.

Further, the umbrella-shaped member includes a cover holding member which includes a step provided at both end portions to reduce a gap with the wall surface of the heating chamber, and also configured to fix the microwave transmitting cover, whereby adhesion of contamination can be prevented, and a tight fit between the microwave transmitting cover and the wall surface of the heating chamber can be secured.

Advantages of the Invention

According to the high-frequency cooker of the present invention, an umbrella-shaped member provided on a surface upper than the power feed port so as to cover an upper edge of the microwave transmitting cover, whereby it is possible to prevent contamination due to vapor or seasoning from food and also prevent a microwave transmitting cover from being molten/deformed

MODE FOR CARRYING OUT THE INVENTION

In a first invention, a high-frequency cooker includes: a heating chamber; high-frequency generating means; a waveguide which is formed on a surface opposite to the heating chamber and which guides a microwave generated by the high-frequency generating means; a power feed port which is formed on a wall of the heating chamber and which allows the microwave guided by the waveguide to be supplied into the heating chamber; a microwave transmitting cover which closes the power feed port; and an umbrella-shaped member which is provided on a surface upper than the power feed port so as to cover an upper edge of the microwave transmitting cover.

Thus, even when a vapor or seasoning arising from food in a heating chamber at the microwave cooking of the food is dispersed, adheres to a wall surface of the heating chamber and flows down, the umbrella-shaped member prevents the vapor or seasoning from adhering to a front side or a back side of the microwave transmitting cover, whereby the microwave transmitting cover is not molten/deformed.

In the second invention, the umbrella-shaped member according to the first invention includes a cover holding member which includes a step provided at both end portions to reduce a gap with the wall surface of the heating chamber, and also configured to fix the microwave transmitting cover.

This configuration can prevent adhesion of contamination, and can also secure a tight fit between the microwave transmitting cover and the wall surface of the heating chamber.

Hereinafter, embodiments of the present invention will be described with reference to the drawings. However, the present invention is not limited to the embodiments of the present invention.

(Embodiment 1)

Figure 1:
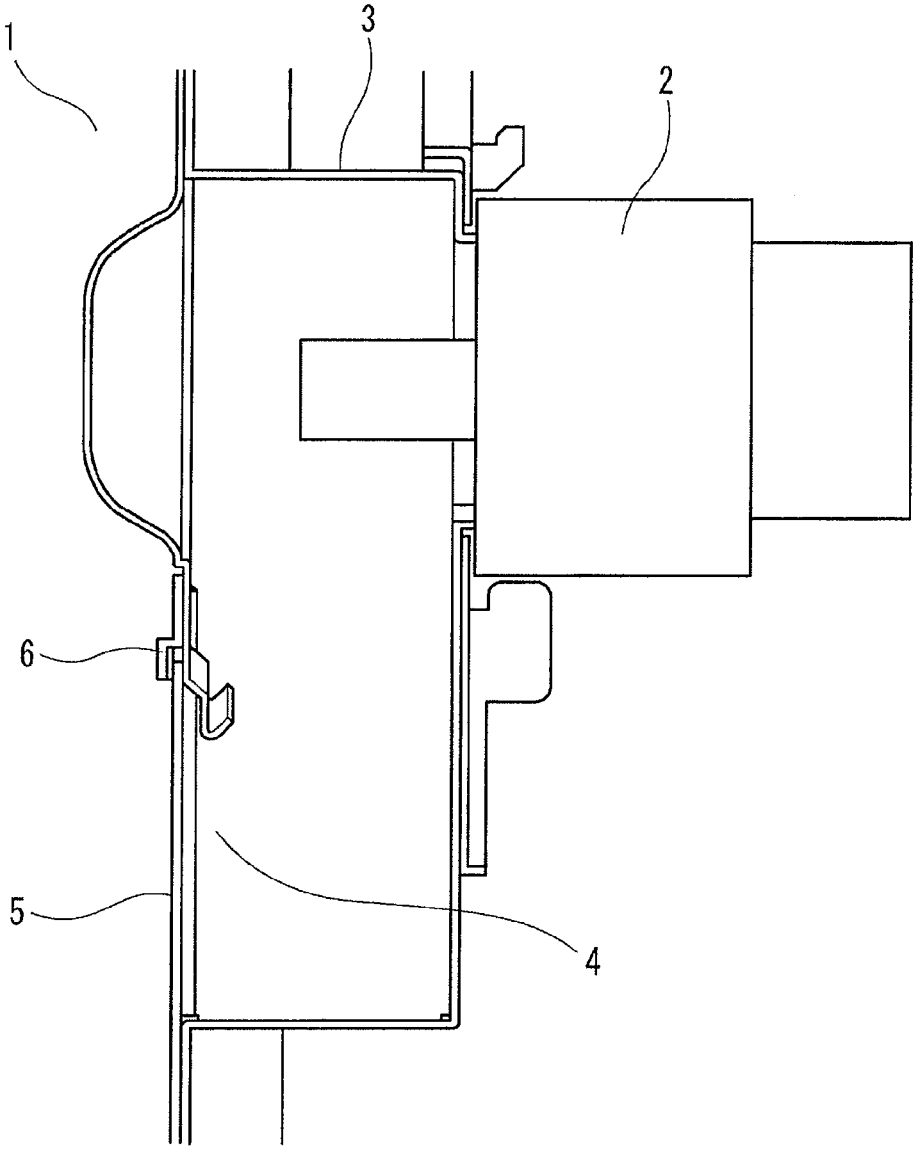
FIG. 1 is a cross-sectional view of a high-frequency cooker according to an embodiment 1 of the present invention showing a relevant part.
Figure 2:
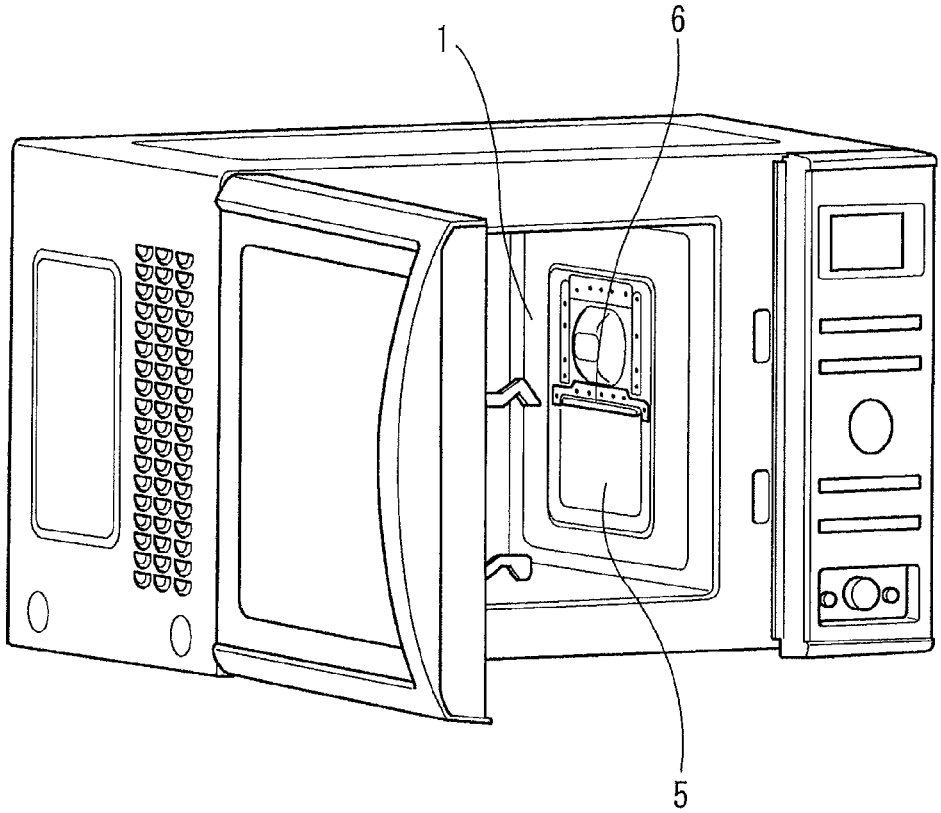
FIG. 2 is a perspective view of the high-frequency cooker according to the embodiment 1 of the present invention.

FIG. 1 is a cross-sectional view of a high-frequency cooker according to the first embodiment of the present invention showing a relevant part, and FIG. 2 is a perspective view of the high-frequency cooker according to the first embodiment of the present invention.

In FIG. 1, the high-frequency cooker according to the first embodiment of the present invention includes: a heating chamber 1 for heating an object to be heated; a magnetron 2 serving as high-frequency generating means; a waveguide 3 provided on a wall surface that is a surface opposite to the heating chamber 1; a power feed port 4 provided on a wall surface of the heating chamber 1; a microwave transmitting cover 5 which closes the power feed port 4 in order to prevent entry of a vapor or contamination from the power feed port 4, and an antifouling cover 6 which covers an upper edge of the microwave transmitting cover 5.

Hereinafter, the operation and effect of the high-frequency cooker having the configuration described above will be described. First, a microwave generated from the magnetron 2 is guided by the waveguide 3, and is supplied into the heating chamber 1 through the power feed port 4, whereby food in the heating chamber is cooked.

At this time, a wall surface electric current by the microwave flows on an edge face of the power feed port 4 to generate heat. Further, a larger wall surface electric current flows at a circumferential portion of the power feed port 4 close to the magnetron 2 to generate more heat. In general, when food in a heating chamber is cooked by a microwave, a vapor arises, or seasoning is dispersed.

At this time, the vapor or seasoning which adheres to the wall surface of the heating chamber 1 flows on the wall surface of the heating chamber 1, and adheres to a front side of the microwave transmitting cover 5.

In addition, there is a gap between the microwave transmitting cover 5 and the wall surface of the heating chamber, so that the vapor or seasoning sometimes flows through the gap, and may adhere also to a back side of the microwave transmitting cover 5. If the vapor or seasoning adheres to the circumferential portion of the edge face of the power feed port 4, the portion is intensively heated by the microwave to generate more heat to melt/deform the microwave transmitting cover. However, since the antifouling cover 6 serving as an umbrella-shaped member is provided so as to cover the upper edge of the microwave transmitting cover 5, it is possible to prevent the vapor or seasoning from adhering to the front side or the back side of the microwave transmitting cover, whereby the microwave transmitting cover can be prevented from being molten/deformed.

(Embodiment 2)

Figure 3:
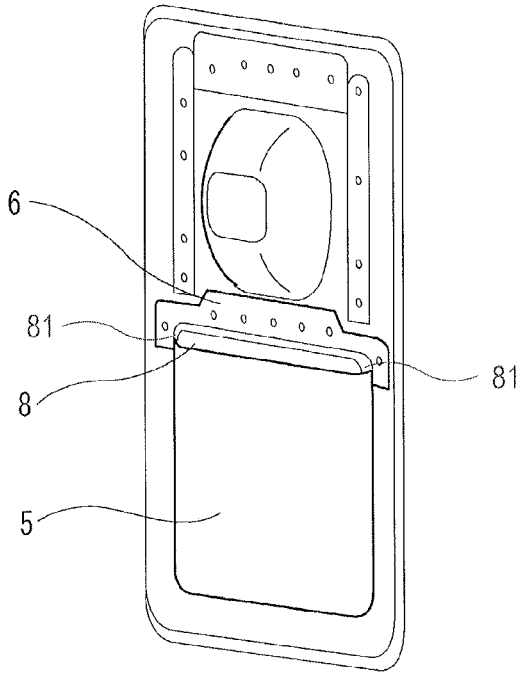
FIG. 3 is a perspective view of a high-frequency cooker according to an embodiment 2 of the present invention showing a relevant part.
Figure 4:
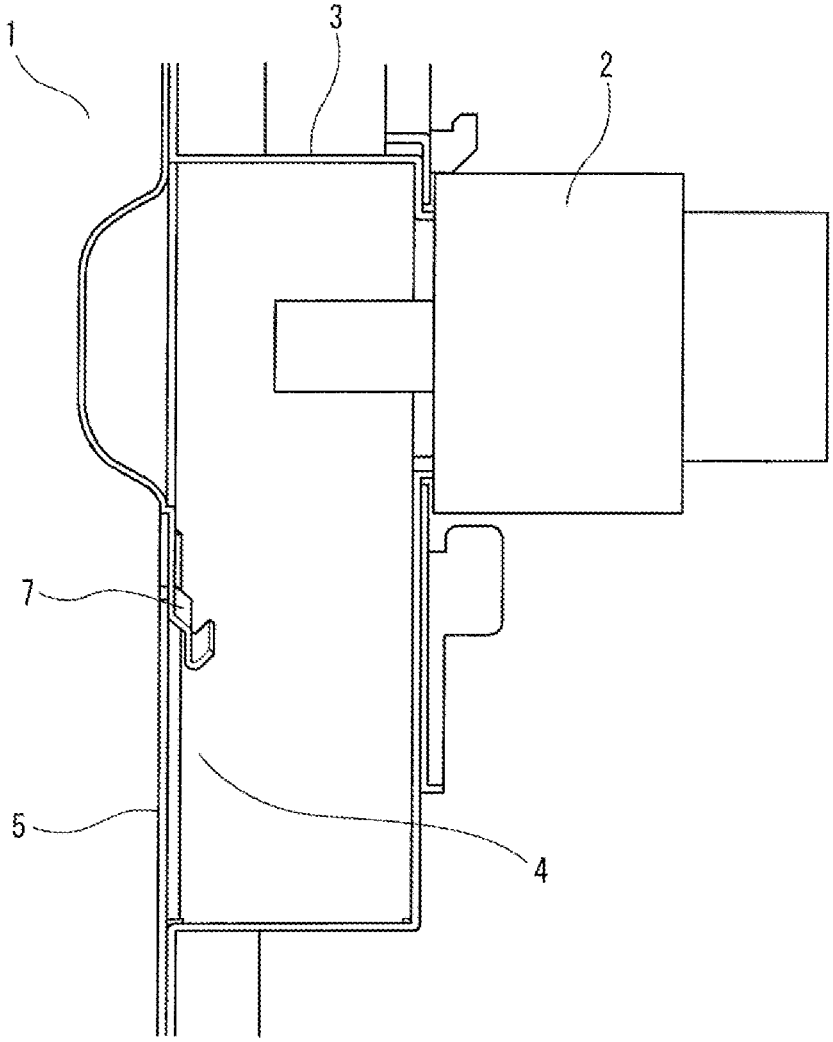
FIG. 4 Prior Art
FIG. 4 is a cross-sectional view of a conventional high-frequency cooker showing a relevant part.

FIG. 3 is a perspective view of a high-frequency cooker according to the second embodiment of the present invention showing a relevant part. Descriptions of parts which are same as or equivalent to the parts according to the first embodiment of the present invention are omitted or simplified.

In FIG. 3, the umbrella-shaped antifouling cover 6 is provided so as to cover the upper edge of the microwave transmitting cover 5, and includes a cover holding member 8 which includes steps 81 provided at both end portions of the antifouling cover 6 to reduce a gap with the wall surface of the heating chamber 1. The microwave transmitting cover 5 is fixed so as to be inserted into the gap, and is pressed by the cover holding member 8 so as to be brought into intimate contact with the wall surface of the heating chamber 1, thereby improving a tight fit between the microwave transmitting cover 5 and the wall surface of the heating chamber 1, and further preventing the vapor or seasoning from easily entering the back side of the microwave transmitting cover 5.

In addition, since the cover holding member 8 is provided at both the end portions of the antifouling cover 6, heat is less generated by the microwave at these portions, so that even if an overlap width of an umbrella portion of these portions decreases, the microwave transmitting cover 5 is not molten/deformed.

This application is based on the Japanese patent application filed on Jul. 26, 2011 (Application No. 2011-162738), the entire contents of which are incorporated herein by reference.

INDUSTRIAL APPLICABILITY

As described above, the high-frequency cooker according to the present invention can prevent the deficiency in that the microwave transmitting cover is molten/deformed, even if the chamber is used for a long period of time and fouled. Accordingly, the present invention is effectively applicable to a high-frequency cooker.

The invention claimed is:

1. A high-frequency cooker comprising:

a heating chamber comprising a wall surface extending in a substantially vertical direction;

a high-frequency generating device;

a waveguide on a surface opposite to the heating chamber and configured to guide a microwave generated by the high-frequency generating device;

a power feed port on the wall surface of the heating chamber and configured to supply the microwave guided by the waveguide into the heating chamber;

a microwave transmitting cover closing the power feed port; and an umbrella-shaped member on a portion of the wall surface above the power feed port in the vertical direction and covering a vertical upper edge of the microwave transmitting cover, the umbrella-shaped member having end portions and a central portion extending along the wall surface in the vertical direction away from the vertical upper edge of the microwave transmitting cover and the end portions, wherein the umbrella-shaped member further comprises a horizontally disposed step at both end portions of the umbrella-shaped member, the step reduces a gap between the umbrella-shaped member and the wall surface of the heating chamber, and the microwave transmitting cover is fixed so as to be inserted into the gap.

2. A high-frequency cooker comprising:

a heating chamber comprising a wall surface extending in a substantially vertical direction;

a high-frequency generating device;

a waveguide on a surface opposite to the heating chamber and configured to guide a microwave generated by the high-frequency generating device;

a power feed port on the wall surface of the heating chamber and configured to supply the microwave guided by the waveguide into the heating chamber;

a microwave transmitting cover closing the power feed port; and an umbrella-shaped member on a portion of the wall surface above the power feed port in the vertical direction and covering a vertical upper edge of the microwave transmitting cover, wherein a vertical lower part of the umbrella-shaped member comprises: a horizontal end portions that contact the wall surface; and a horizontal center portion located between the horizontal end portions, wherein the horizontal center portion opposes the wall surface with a gap to define a space opened downward, wherein a portion of the vertical lower part of the umbrella-shaped member, which connects the horizontal center portion and each of the horizontal end portions, forms a step that reduces the gap between the umbrella-shaped member and the wall surface from the horizontal center portion toward each of the horizontal end portions, and wherein the microwave transmitting cover is fixed so as to be inserted into the gap.

* * * * *